United States Patent [19]

Hirano et al.

[11] Patent Number: 4,856,973

[45] Date of Patent: Aug. 15, 1989

[54] SCROLL-TYPE FLUID MACHINE WITH SPECIFIC INNER CURVE SEGMENTS

[75] Inventors: Takahisa Hirano; Kiyoshi Hagimoto, both of Nagoya; Kimiharu Takeda, Aza-asahi, all of Japan

[73] Assignee: Mitsubishi Jukogyo Kabushiki Kaisha, Japan

[21] Appl. No.: 146,618

[22] Filed: Jan. 21, 1988

[30] Foreign Application Priority Data

Jan. 27, 1987 [JP] Japan ..... 62-17074
Jul. 3, 1987 [JP] Japan ..... 62-166450

[51] Int. Cl.[4] ..... F01C 1/04
[52] U.S. Cl. ..... 418/55; 418/150
[58] Field of Search ..... 418/55, 150

[56] References Cited

U.S. PATENT DOCUMENTS 4,547,137 10/1985 Terauchi et al. ..... 418/55
4,678,415 7/1987 Hirano et al. ..... 418/150
4,678,416 7/1987 Hirano et al. ..... 418/150

FOREIGN PATENT DOCUMENTS 58-101285 6/1983 Japan ..... 418/150
60-256581 12/1985 Japan ..... 418/150

*Primary Examiner*—John J. Vrablik
*Attorney, Agent, or Firm*—McGlew & Tuttle

[57] ABSTRACT

A scroll-type fluid machine includes a stationary spiral element and a revolving spiral element having a substantially identical configuration and a central small chamber defined between abutting points of both the spiral elements a volume of which is adapted to be reduced to substantially zero with relative rotation of both the spiral elements. Basically, each of the both spiral elements is formed of an outer curve segment and an inner curve segment formed of involute curves and a connection inner curve expressed by a particular equation and a connection outer curve expressed by another particular equation formed between the outer and inner curve segment. The strength of the spiral elements can be enhanced or a delivery port having a large area can be provided.

2 Claims, 12 Drawing Sheets

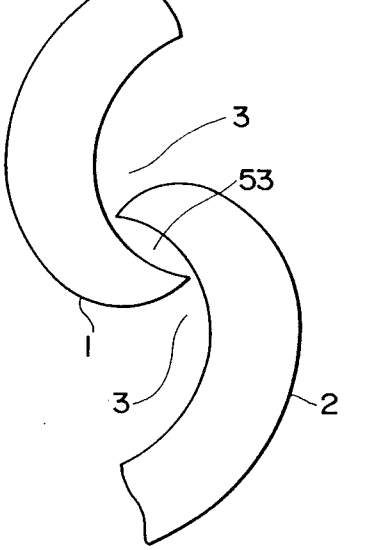
FIG. 11 (C) (PRIOR ART)
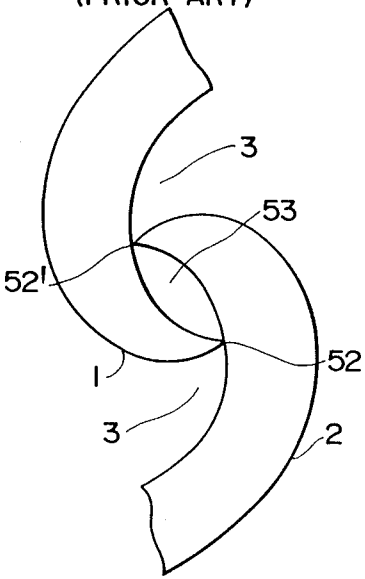
FIG. 11 (B) (PRIOR ART)
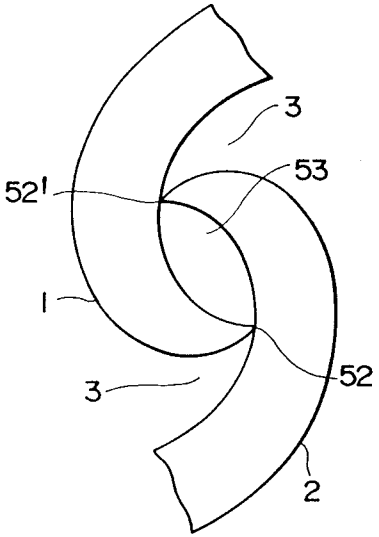
FIG. 11 (A) (PRIOR ART)

SCROLL-TYPE FLUID MACHINE WITH SPECIFIC INNER CURVE SEGMENTS

FIELD OF THE INVENTION AND RELATED ART STATEMENT

The present invention relates to a scroll-type fluid machine including spiral elements, and more particularly to a central geometry of the spiral elements.

A known scroll-type compressor, for example, as shown in FIG. 8 illustrating the principle of operation comprises two scroll or spiral elements having an identical configuration, one element 2 of which is fixedly mounted to a sealing end plate having a generally central delivery opening 4. The two spiral elements are shifted in rotation relatively 180 degrees apart from each other and are also shifted in relative location by a distance $2\rho$(=the pitch of a spiral pattern-2×thickness of a spiral element plate) so as to be nested in position with each other in such a manner, as schematically shown in the figure, that they may be located in their relative position to come in abutting contact with each other at four points 51, 52 and 51', 52'. According to this construction, it is further noted that the one spiral element 2 is disposed stationary in position, and the other element 1 is arranged to move in revolution or in a solar-orbital motion with a radius of $\rho=00'$ about the center 0 of the spiral element 2, without moving in rotation or in planetary motion on its own axis, by using a crank mechanism having a radius $\rho$.

With such construction, there are defined small spaces or chambers 3, 3 being tightly enclosed extending along and between the abutting points 51, 52 and 51', 52' of the spiral elements 1, 2, respectively, the volumes of which chambers 3, 3 vary gradually in continuation with the solar or revolving motion of the spiral elements 1.

Reviewing more specifically, it is notable that when the spiral element 1 is first caused to be revolved 90 degrees starting from the position shown in FIG. 8(A), it turns now to be in the state as shown in FIG. 8(B), when it is revolved 180 degrees, then it turns to be in the state as shown in FIG. 8(C), and when it is further revolved 270 degrees, it turns then to be in the state as shown in FIG. 8(D). As the spiral element 1 moves along in revolution, the volumes of the small chambers 3, 3 decrease gradually in continuation, and eventually, these chambers come in communication with each other and merge into one tightly enclosed small chamber 53. Now, when it moves in revolution further 90 degrees from the state shown in FIG. 8(D), it turns back to the state in position as shown in FIG. 8(A), and the small chamber 53 would then be caused to be reduced in its volume as it turns from the state shown in FIG. 8(B) to that shown in FIG. 8(C), and eventually it would turn to a smaller volume intermediate the states shown in FIGS. 8(C) and (D). During this stage of motion in revolution, outer spaces starting to be opened as seen in FIG. 8(B) grow to be greater as the element 1 turns along from the state of FIG. 8(C) through the state of FIG. 8(D) to the state of FIG. 8(A), thus introducing another volume of a new gas from the outer spaces into the tightly enclosed small chamber to be eventually merged together, and then repeating this cycle of revolutionary motion so that the gas thustaken into the outer spaces of the spiral elements may accordingly be compressed, thus being delivered out of the delivery opening 4.

The foregoing description is concerned with the general principle of operation of the scroll-type compressor, and now, referring more concretely to the construction of this scroll-type compressor by way of FIG. 9 showing in longitudinal cross-section the general construction of the compressor, it is seen that a housing 10 is comprised of a front end plate 11, a rear end plate 12 and a cylindrical plate 13. The rear end plate 12 is provided with an intake port 14 and a delivery port 15 both extending outwardly therefrom, and further installed securely with a stationary scroll member 25 comprising a spiral or helical fin 252 and a disc 251. The front end plate 11 is adapted to pivotally mount a spindle 17 having a crank pin 23. As typically shown in FIG. 10 which is a transversal cross-sectional view taken along the plane defined by the arrow X—X in FIG. 9, in mutually operative relationship with the crank pin 23 there is provided a revolving scroll member 24 including a spiral element 242 and a disc 241 through a revolving mechanism, which comprises a radial needle bearing 26, a boss 243 of the revolving scroll member 24, a square-section sleeve member 271, a slider element 291, a ring member 292, a stopper lug 293 and the like.

The practice of design engineering of the general configuration of the scroll or spiral elements 1, 2 to be incorporated in the scroll-type compression machine is, as described in detail in the Japanese Patent Application No. 197,672/1981 filed by the present inventors, such that the major parts of the radially inner and outer profile curves of these spiral elements may generally be designed consisting of the involute functions. As stated also in the description on the principles of operation of this type of compression machine given above, the small chamber 53 would have its working volume reduced for a certain part of its operation cycle, thus providing the delivery of high pressure fluid out of the delivery port. In connection with this cycle of operation, there is encountered the phenomenon of so-called "top clearance volume" arising from the fact that the volume of the small chamber cannot be zeroed or excluded from existence because of a thickness of the spiral element which cannot be nullified in the actual design of construction.

Reviewing more specifically, as shown further in detail in FIG. 11, an enlarged fragmentary view of the core portions of the spiral elements, in which drawing figure (A) corresponds to FIG. 8(C), the small chamber 53 defined between the points of contact 52 and 52' of the two complementary spiral elements 1, 2 willl be in its working position as shown in a similar manner in FIG. 11(B), when the spiral element 1 is caused to be moved in revolutionary motion, where the volume of the small chamber 53 turns out to be smallest. Then, when the spiral element 1 is moved further in revolution passing this specific point of engagement, the spiral elements 1, 2 are moved away from each other, thus having the points of contact therebetween 52, 52' dissolved accordingly. At this moment, the small chamber 53 as defined between these two spiral elements 1, 2 turns in communication with the small chambers 3, 3 defined outside of each of the spiral elements.

From this locational relationship in the generally known construction of the rotary machine, it is inevitable that the fluid under high pressure confined in the smallest volume as shown in FIG. 11(B) is therefore put again in communication with small chambers 3, 3 instead of being delivered out of the delivery port 4. For this reason, the work done thus far upon the fluid body corresponding to the top clearance volume in question would immediately be turned out to be a loss of work, accordingly.

Also, as it is the general practice of design engineering in the conventional rotary machine construction that the leading ends of the spiral elements 1 and 2 are of a sharp corner, it would then be subjected to relatively high possibility of damage during the operation. Moreover, this sharp-cornered leading end of the spiral element would generally require an additional number of man-hours in machining work.

In order to solve these drawbacks which are particular to the conventional rotary fluid machines as referred to above, the present inventors have previously proposed the rotary type fluid machine in which the top clearance volume is substantially reduced to zero to attain a highly efficient operation having a long life so that losses are minimized and which is manufactured easily as disclosed in the Japanese Patent Application No. 206,088/1982. More particularly, there has been proposed the construction of spiral elements composed of a stationary spiral element and a revolving spiral element both having the identical configuration, in which the volume of a small central chamber formed between abutting points of both the spiral elements is substantially reduced to zero with a relative rotating movement of the elements and each of the spiral elements is defined by a radially outer curve, a radially inner curve having a circular arc inside of the outer curve and a circular arc connecting both the curves.

Referring more specifically to the construction of the spiral elements disclosed in the Japanese Patent Application No. 206,088/1982, the general construction is of such as shown schematically in FIG. 12 that there is provided a stationary spiral element designated by the reference numeral 501, wherein the curves of the radially outer and inner surfaces of the spiral element 501 are designated at 601 and 602, respectively. The radially outer curve 601 is defined as an involute curve havin a base circle radius b and the starting point A, the curve section E–F of the radially inner curve 602 is an involute curve having the shift in phase of $(\pi-\rho/b)$ with respect to the radially outer curve 601, and the curve section D–E is an arc having the radius R. The connection curve 603 for connecting smoothly the radially outer and inner curves 601 and 602 is an arc having the radius r. The point A is the starting point of the outer curve 601 in the involute curve, and the point B is the boundary point between the outer curve 601 and the connection curve 603, where both the curves share the same tangential line. The point C is the one that is defined sufficiently outside of the radially outer curve 601, and the point D is the boundary point between the inner curve 602 and the connection curve 603, at which point there are two arcs having the radii R and r in osculating relationship with each other. The point E is a boundary point between the arc section (between the points from D to E) of the radially inner curve 602 and the involute curve section E–F, where both the curves share the same tangential line. The point F is seen to be the one which exists sufficiently outside of the inner curve 602.

It is noted that the other revolving spiral element 502 has the identical construction.

Now, the radii R and r may be given with the following equations; that is $$R=\rho+b\beta+d$$

$$r=b\beta+d$$

where, $\rho$ is the radius of revolutionary motion;

b is the radius of the base circle;

$d=\{b^2-(\rho/2+b\beta)^2\}/2(\rho/2+b\beta)$ $\beta$ is a parameter.

The parameter $\beta$ is equal to an angle defined by a straight line segment passing the origin 0 and the X-axis in the negative quadrant. Two points of intersection of the straight line segment passing the origin 0 and at the angle of $\beta$ and the base circle are seen existing in the line segments $EO_2$ and $BO_1$ which are parallel with each other. It is also seen that the straight line segments $EO_2$ and $BO_1$ extend in osculation with the base circle at the points of intersection noted above.

Further, the Japanese Patent Application No. 167,063/1982 discloses the same idea as that of the abovementioned Japanese Patent Application No. 206,088/1982. In this Application, as shown in FIG. 13, the radii of both the arcs are given by $$R = \{(2rg\cdot\alpha + \pi\cdot rg - 2\beta\cdot rg)^2 + (2rg)^2/4(2rg\cdot\alpha + \pi\cdot rg - 2\beta\cdot rg)\} + r/2$$

$$r = R - r.$$

where, rg is the radius of a base circle, $\beta$ is a phase angle of the inner and outer walls ($2\beta$.rg is a thickness of the wall) and r is the radius of a revolution.

In the above-mentioned Japanese Patent Application Nos. 206,088/1982 and 167,063/1982, the top clearance which is the drawback in the prior art is reduced and the center sharp edge of the spiral element is removed to increase the strength of the spiral element. However, in the Japanese Patent Application No. 206,088/1982, when the radius b of the base circle and the radius $\rho$ of the revolution are determined and the parameter of $\beta$ is then determined, the central shape of the spiral element is uniquely determined. Consequently, the central shape of the spiral element cannot be further corrected with a view to increasing the strength or providing a larger delivery port. The Japanese Patent Application No. 167,063/1982 possesses the same defect as above if the radius rg of the base circle, the angle $\beta$ and the parameter $\alpha$ are determined.

Further, there is a drawback as follows. Both the conventional propositions described above are basically directed to both the spiral elements each having the same thickness (the thickness of the involute portion) and the identical configuration. Accordingly, when the machine is adapted to be made to a large size or to operate at a high speed, the revolving scroll member (revolving spiral element) receives a large centrifugal force and the life of a rotating bearing which drives the revolving scroll member is shortened.

In order to solve the above drawback, there is considered that the revolving scroll member is manufactured of, for example, Al material having small specific gravity. In this case, the strength of Al material is relatively low and accordingly the strength of the spiral elements becomes a problem. More particularly, the stationary scroll member which does not receive the centrifugal force employs, for example, iron material having relatively large specific gravity and high strength, while the revolving scroll member which receives the centrifugal force employs, for example, Al (aluminum) material having relatively small specific gravity and small strength. Even with this configuration, since the thickness of both the spiral elements is the same, the strength of the stationary spiral element is large and the strength of the revolving spiral element is small, resulting in the unbalance in the strength. This defect is caused by the same construction in the shape of the revolving and stationary spiral elements.

OBJECT AND SUMMARY OF THE INVENTION

Accordingly, it is an object of the present invention to provide a scroll-type fluid machine including spiral elements which can reduce the top clearance volume to substantially zero and can have an enhanced strength or a space for providing a delivery port.

In order to achieve the above object of the present invention, there is provided an improved construction of the scroll-type fluid machine including a stationary spiral element and a revolving spiral element both having a substantially identical configuration and in which is volume of a central small chamber formed between abutting points of both the spiral elements is reduced to substantially zero, characterized in that each of the spiral elements is defined in profile with an outer curve segment and an inner curve segment consisting of involute curves, respectively, and a portion between the outer and inner curve segments is substantially formed of a connection inner curve expressed by the following equation (1) and a connection outer curve expressed by the following equation (2).

A connection inner curve of one of the spiral elements:

$$\begin{bmatrix} xf_1(t) \\ yf_1(t) \end{bmatrix} = \phi(t)\begin{bmatrix} r_1(t) \\ o \end{bmatrix} - \phi(\beta_1)\begin{bmatrix} b \\ d_1 \end{bmatrix} \quad (1)$$

where $tc \leqq t \leqq \pi/2+\beta_1$

A connection outer curve of one of the spiral elements:

$$\begin{bmatrix} xf_0(t) \\ yf_0(t) \end{bmatrix} = \phi[t - \tan^{-1}((dr_2(t)/dt)/r_2(t))]\begin{bmatrix} \rho \\ o \end{bmatrix} - \phi(t)\begin{bmatrix} r_2(t) \\ o \end{bmatrix} + \phi(\beta_2)\begin{bmatrix} b \\ d_2 \end{bmatrix} \quad (2)$$

where $tc \leqq t \leqq \pi/2+\beta_2$

A connection inner curve of the other of the spiral elements:

$$\begin{bmatrix} xm_1(t) \\ ym_1(t) \end{bmatrix} = \phi(t)\begin{bmatrix} r_2(t) \\ o \end{bmatrix} - \phi(\beta_2)\begin{bmatrix} b \\ d_2 \end{bmatrix} \quad (17)$$

where $t_c \leqq t \leqq \pi/2=\beta_2$

A connection outer curve of the other of the spiral elements:

$$\begin{bmatrix} xm_0(t) \\ ym_0(t) \end{bmatrix} = \phi[t - \tan^{-1}((dr_1(t)/dt/r_1(t))]\begin{bmatrix} \rho \\ o \end{bmatrix} - \phi(t)\begin{bmatrix} r_1(t) \\ o \end{bmatrix} + \phi(\beta_1)\begin{bmatrix} b \\ d_1 \end{bmatrix} \quad (18)$$

where $t_c \leqq t \leqq \pi/2=\beta_1$

With the above spiral elements, the following effects are attained.

(1) The thickness of the stationary spiral element and the revolving spiral element can be changed.

(2) The top clearance can be reduced to zero.

(3) The configuration of only the central portion of the spiral element can be changed to enhance the strength thereof without changing various parameters b and $\rho$ of the involute curve and the marginal angular parameter $\beta$ defining the involute curve if necessary.

Thus, the spiral element, specifically the central portion thereof can maintain the top clearance volume to be zero while the strength thereof can be increased by parameter n or a delivery port having a large area can be provided without changing the various parameters b and $\rho$ of the spiral element.

Further, according to a second invention, the thickness of both the spiral elements can be changed to obtain a desired strength.

Accordingly, the present invention is extremely useful in the industrial field.

BRIEF DESCRIPTION OF THE DRAWINGS

FIGS. 5(A) to 5(E) show in front view the stationary spiral element of FIG. 4 in the case where parameter n is changed;

FIGS. 11(A) to 11(C) are partially enlarged views of the spiral elements shown in FIGS. 8(C) and (D);

DETAILED DESCRIPTION OF PREFERRED EMBODIMENTS

Embodiments of the present invention are now described with reference to the drawings.

Figure 1:
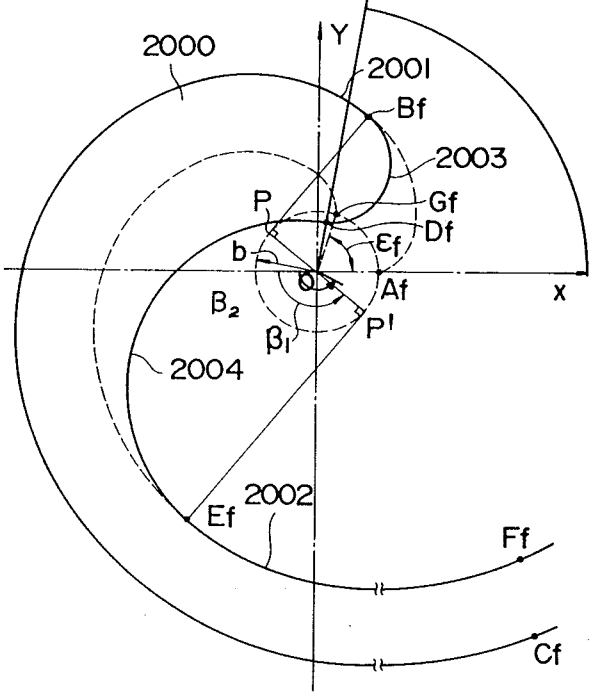
FIG. 1 is a front view of a stationary spiral element according to an embodiment of the present invention.

In FIG. 1, a stationary spiral element is formed as follows: An involute curve Af–Cf is drawn starting from a point Af on the X-axis on a base circle having the radius b. An involute curve Gf–Ff is drawn which is shifted from the involute curve Af–Cf by an offset angle $\epsilon f$ given by $$\epsilon f = \pi - \rho/b - \Delta T/b$$

The points Af and Gf exist on the base circle having the radius b.

$$<AfOGf = \epsilon f$$

$$= \pi - \rho/b - \Delta T/b$$

The points Ff and Cf exist in the area sufficiently outside of the corresponding involute curves.

b: the radius of the base circle of the involute curve;

$\rho$: the rotating radius of the rotating scroll;

$\Delta T$: an increased or decreased value of thickness

Then, the straight lines OP, OP' passing through the center 0 of the base circle, each having an angle $\beta_1$, $\beta_2$ with respect to the negative quadrant of the X-axis are drawn in which P and P' are points existing on the base circle. Tangential lines are drawn on the base circle from the points P and P'. Intersecting points between the tangential lines from the points P and P' and the involute curves Af–Cf and Gf–Ff are defined as Bf and Ef, respectively.

Thus, the stationary spiral element 2000 is composed of a radially outer cuve 2001 which is a part of the involute curve expressed by Bf–Cf and a radially inner curve 2002 which is a part of the involute curve expressed by Ef–Ff.

The thickness Trf of the involute portion of the stationary spiral element 2000 is given by $$Trf = \pi b - \rho - \Delta T$$

A connection inner curve Df–Ef and a connection outer curve Df–Bf between the starting point Bf of the outer curve 2001 (Bf–Cf) and the starting point Ef of the inner curve 2002 (Ef–Ff), that is the curve Bf–Df–Ef, are formed of the following equations (1) and (2), respectively.

A connection inner curve of the stationary spiral element:

$$\begin{bmatrix} xf_1(t) \\ yf_1(t) \end{bmatrix} = \phi(t)\begin{bmatrix} r_1(t) \\ o \end{bmatrix} - \phi(\beta_1)\begin{bmatrix} b \\ d_1 \end{bmatrix} \quad (1)$$

where $t_c \leqq t \leqq \pi/2 + \beta_1$

A connection outer curve of the stationary spiral element:

$$\begin{bmatrix} xf_0(t) \\ yf_0(t) \end{bmatrix} = \phi[t - \tan^{-1}(dr_2(t)/dt/r_2(t))]\begin{bmatrix} \rho \\ o \end{bmatrix} - \phi(t)\begin{bmatrix} r_2(t) \\ o \end{bmatrix} + \phi(\beta_2)\begin{bmatrix} b \\ d_2 \end{bmatrix} \quad (2)$$

where $t_c \leqq t \leqq \pi/2 + \beta_2$

-continued $$r_1(t) = R_1 \sin^{n1}(t - \beta_1) \quad (3)$$

$$r_2(t) = R_2 \sin^{n2}(t - \beta_2) \quad (4)$$

$$t_c = T_1 + \pi/2 + \beta_1 \quad (5)$$

$$d_1/b = [\lambda \sin(T_1 + \tan^{-1}(n_1 \tan T_1)) - 1]/[\sin T_1 \cos^{n1} T_1] - 2\lambda - \beta_1 + \epsilon \quad (6)$$

$$R_1/b = [\lambda \sin(T_1 + \tan^{-1}(n_1 \tan T_1)) - 1]/\sin T_1 \cos^{n1} T_1 \quad (7)$$

$T_1$ is to satisfy the following equation.

$$\cos^{n1} T_1[\cos T_1 - (2\lambda + \beta_1 - \epsilon)\sin T_1 - \lambda \sin(\tan^{-1}(n_1 \tan T_1))] + \lambda \sin(T_1 + \tan^{-1}(n_1 \tan T_1)) - 1 = 0 \quad (8)$$

$$\beta_2 = t_c - \pi/2 - T_2 \quad (9)$$

$$n_2 = n_1 \tan T_1/\tan T_2 \quad (10)$$

$$d_2/b = [\lambda \sin(T_2 + \tan^{-1}(n_2 \tan T_2)) - 1]/\sin T_2 \cos^{n2} T_2 - (t_c - \pi/2 + 2\lambda - T_2) \quad (11)$$

$$R_2/b = [\lambda \sin(T_2 + \tan^{-1}(n_2 \tan T_2)) - 1]/\sin T_2 \cos^{n2} T_2 \quad (12)$$

$T_2$ is to satisfy the following equation.

$$\cos^{n2} T_2[\cos T_2 - (tc - \pi/2 + 2\lambda - T_2)\sin T_2 - \lambda \sin(\tan^{-1}(n_2 \tan T_2))] + \lambda \sin(T_2 + \tan^{-1})(n_2 \tan T_2)) - 1 = 0 \quad (13)$$

$$\lambda = \rho/2b \quad (14)$$

$$\phi(t)\begin{bmatrix} \cos(t) & -\sin(t) \\ \sin(t) & \cos(t) \end{bmatrix} \quad (15)$$

where, b is the radius of the base circle of the involute curve;

$\rho$ is the revolution radius of the revolving scroll;

$\epsilon$ is the angle between the outer curve of the revolving spiral element and the inner curve of the stationary spiral element twisted at the starting portion of the involute curve by $\Delta t$, $$\epsilon = \Delta T/b \quad (16)$$

$\beta_1$ is the starting angle of the involute curve of the stationary spiral element and the outside of the revolving spiral element.

Figure 2:
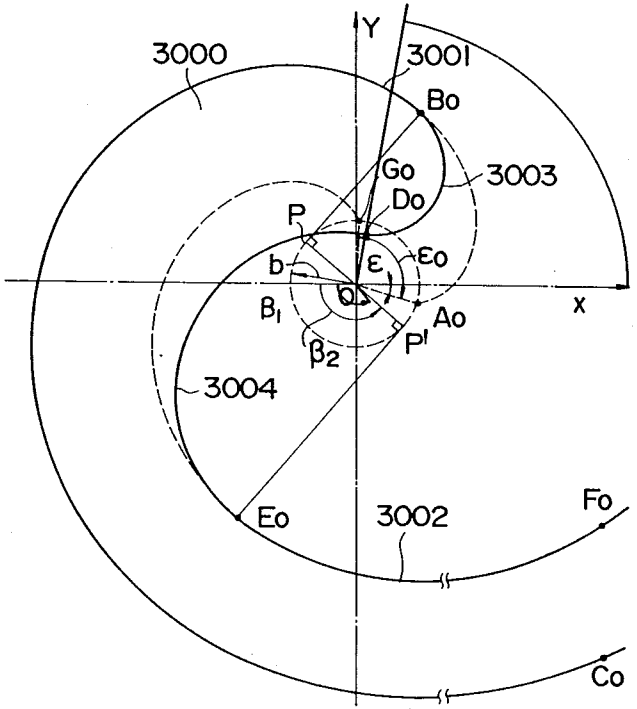
FIG. 2 is a front view of a revolving spiral element corresponding to the stationary spiral element of FIG. 1.

$n_1$ is the real number of the parameter $\geqq 0$ of the connection outer curve of the stationary spiral element and the connection inner curve of the revolving spiral element (note: when the parameter is 0 and 1, an arc is formed);

$\beta_2$ is the starting angle of the involute curve of the inside of the revolving spiral element and the outside of the stationary spiral element;

$n_2$ is the real number of the parameter $\geqq 0$ of the connection outer curve of the revolving spiral element and the connection inner curve of the stationary spiral element (note: when the parameter is 0 and 1, an arc is formed);

$t_c$ in FIG. 1 is the angle from the x-axis to a line intersecting the origin and the connection point Df located between the connection inner curve Df-Ef and the connection outer curve Df-Bf;

$t_c$ in FIG. 2 is the angle from the x-axis to a line passing through the connection point $D_o$ and the origin between the connection inner curve $D_o$-$E_o$ and the connection outer curve $D_o$-$B_o$.

t is a variable; and

ΔT is an increased or decreased value of the thickness.

When the connection inner curve Df-Ef and the connection outer curve Df-Bf are formed by the above equations (1) and (2), the tangential line on the point Bf of the involute curve is identical with the tangential line on the point Bf of the connection outer curve Bf-Bf at the point Bf. Further, at the point Ef, the tangential line on the point Ef of the involute curve Ef-Ff is identical with the tangential line on the point Ef of the connection inner curve Df-Ef. At the point Df, the tangential line on the point Df of the connection outer curve Df-Bf is identical with the tangential line on the point Df of the connection inner curve Df-Ef.

The revolving spiral element 3000 corresponding to the stationary spiral element is formed in FIG. 2 as follows:

An involute curve Ao-Co is drawn from a starting point Ao existing on the base circle of the radius b and rotated by an angle $\epsilon=\Delta T/b$ with respect to the X-axis. An involute curve Go-Fo is drawn which is shifted from the involute curve Ao-Co by the offset angle $\epsilon_o$ given by $$\epsilon_o=\pi-\rho/b+\Delta T/b$$

The points Ao and Go exist on the base circle having the radius b.

$$\angle AoOGo=\epsilon_o=\pi-\rho/b+\Delta T/b$$

The points Fo and Go exist sufficiently outside of the involute curves, respectively.

Then, in the same manner as the stationary spiral element, two straight lines OP, OP′ passing through the center O of the base circle, each having an angle $\beta_2$, $\beta_1$ with respect to the negative quadrant of the X-axis, are drawn. The points P and P′ exist on the base circle. Tangential lines are drawn with respect to the base circle from the points P and P′ and intersecting points between the tangential line from the points P and P′ and the involute curves Ao-Co and Go-Fo are Bo and Eo, respectively.

Thus, the revolving spiral element 3000 is composed of a radially outer curve 3001 which is a part of the involute curve expressed by Bo-Co and a radially inner curve 3002 which is a part of the involute curve expressed by Eo-Fo.

The thickness Tro of the involute portion of the revolving spiral element 3000 is given by $$Tro=\pi b-\rho+\Delta T$$

Further, the curve Bo-Do-Eo between the starting point Bo of the outer curve 3001 (Bo-Co) and the starting point Eo of the inner curve 3002 (Eo-Fo) includes a connection inner curve Do-Eo and a connection outer curve Do-Bo formed by the following equations (17) and (18), respectively, in the same manner as in the stationary spiral element.

A connection inner curve of the revolving spiral element:

$$\begin{bmatrix} xm_1(t) \\ ym_1(t) \end{bmatrix} = \phi(t)\begin{bmatrix} r_2(t) \\ 0 \end{bmatrix} - \phi(\beta_2)\begin{bmatrix} b \\ d_2 \end{bmatrix} \tag{17}$$

where $t_c \leqq t \leqq \pi/2+\beta_2$

A connection outer curve of the revolving spiral element:

$$\begin{bmatrix} xm_0(t) \\ ym_0(t) \end{bmatrix} = \phi(t - \tan^{-1})(dr_1(t)/dt/r_1(t))]\begin{bmatrix} \rho \\ 0 \end{bmatrix} - \phi(t)\begin{bmatrix} r_1(t) \\ 0 \end{bmatrix} + \phi(\beta_1)\begin{bmatrix} b \\ d_1 \end{bmatrix} \tag{18}$$

where $t_c \leqq t \leqq \pi/2+\beta_1$

As described above, when the connection inner curve Do-Eo and the connection outer curve Do-Bo of the revolving spiral element 3000 are formed by the equations (17) and (18), the tangential line on the point Bo of the involute curve is identical with the tangential line on the point Bo of the connection outer curve Do-Bo in the same manner as the stationary spiral element 2000. At the point Eo, the tangential line on the point Eo of the involute curve Eo-Fo is identical with the tangential line on the point Eo of the connection inner curve Do-Eo. Further, at the point Do, the tangential line on the point Do of the connection outer curve Do-Bo is identical with the tangential line on the point Do of the connection inner curve Do-Eo. Thus, the following relation is obtained.

$$\epsilon = \Delta T/b \tag{16}$$

$$\epsilon f = \pi - \rho/b - \Delta T/b = \pi - \rho/b - \epsilon \tag{19}$$

$$\epsilon_o = \pi - \rho/b + \Delta T/b = \pi - \rho/b - \epsilon \tag{20}$$

$$Trf = \pi b - \rho - \Delta T \tag{21}$$

$$Tro = \pi b - \rho + \Delta T \tag{22}$$

Accordingly, if numerical values for ρ, b, ΔT, $\beta_1$ and $n_1$ are given and the $\beta_2$ and $n_2$ are obtained from the above equations, the configuration of both the spiral elements can be determined.

Figure 3B:
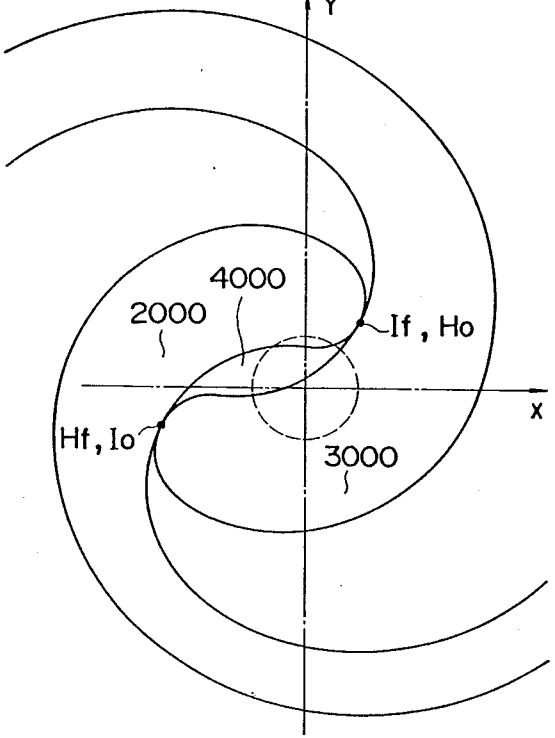
FIGS. 3(A) to 3(D) show progressive states in engagement of both the spiral elements shown in FIGS. 1 and 2.
Figure 3A:
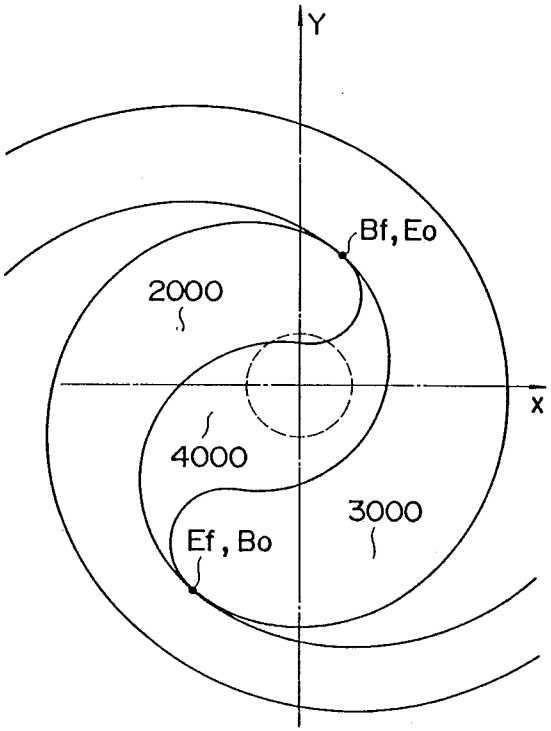
Figure 3:
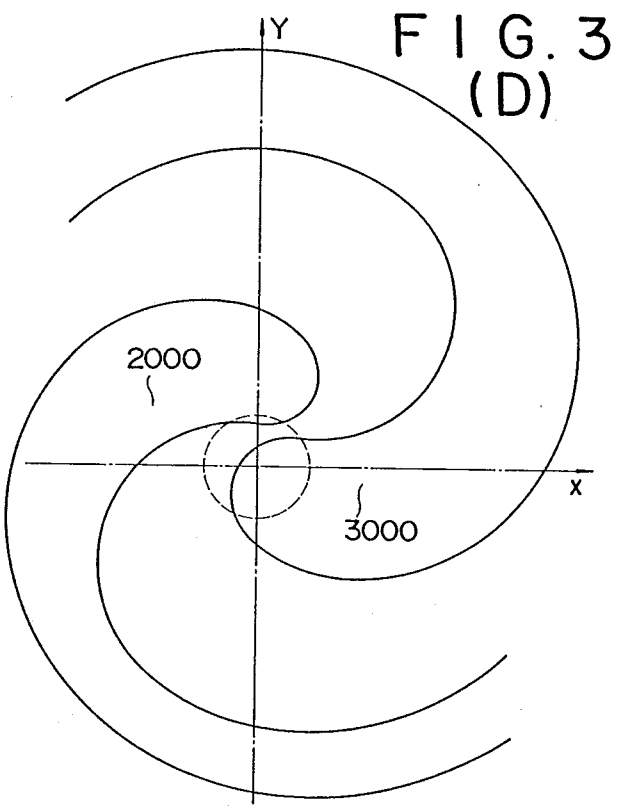
Figure 3:
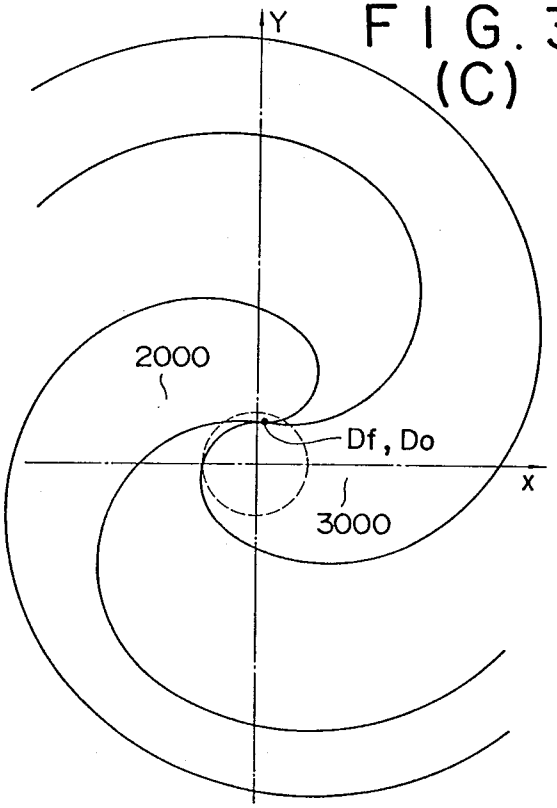

The stationary spiral element 2000 and the revolving spiral element 3000 formed as described above and having different thickness are engaged with each other while being shifted by 180 degrees from each other as shown in FIG. 3, and the revolving spiral element 3000 revolves around the stationary spiral element 2000 with a radius ρ.

In FIG. 3(A), the stationary spiral element 2000 and the revolving spiral element 3000 are engaged with each other while the points Bf and Ef of the stationary spiral element 2000 and the points Eo and Bo of the revolving spiral element 3000 are in contact with each other, respectively, so that a small chamber 4000 is formed. Both the spiral elements are engaged with each other along the involute curve to the state shown in FIG. 3(A).

Further, when the revolving spiral element is revolved, the spiral element is changed to the state shown in FIG. 3(B) and a point Io on the connection outer curve and a point Ho on the connection inner curve of the revolving spiral element 3000 are engaged with a point Hf on the connection inner curve and a point Hf on the connection outer curve of the stationary spiral element 2000 to form the small chamber 4000 continuously.

When the revolving spiral element is further revolved, both the spiral elements 2000 and 3000 are engaged with each other on only one point in which the point Do on the revolving spiral element 3000 exists on the point Df on the stationary spiral element 2000 and the volume of the small chamber is zero.

Further, when the revolving spiral element 3000 is revolves, both the spiral elements begin to separate from each other and return to the state of FIG. 3(A) through the state shown in FIG. 3(D). Accordingly, with the scroll-type fluid machine described above, the compressed fluid is delivered through the delivery port (not shown) to the outside while both the spiral elements having different thickness maintain the top clearance volume to zero. Thus, all the work of the compression machine is given to the fluid and any loss is eliminated.

In the above embodiment, the thicknesses of the stationary spiral element and the revolving spiral element are given by the equations (21) and (22), respectively. The configuration of the center of each of the spiral element is changed in accordance with the involute curve thereof and the strength of the spiral element can be changed properly by the variable ΔT. Accordingly, the configuration, thickness and strength satisfying desired conditions can be determined by determining ΔT.

For example, if the stationary spiral element and the revolving spiral element are made of iron and Al material, respectively, and ΔT is selected properly, the strength of both the spiral elements can be substantially equal to each other.

Figure 4:
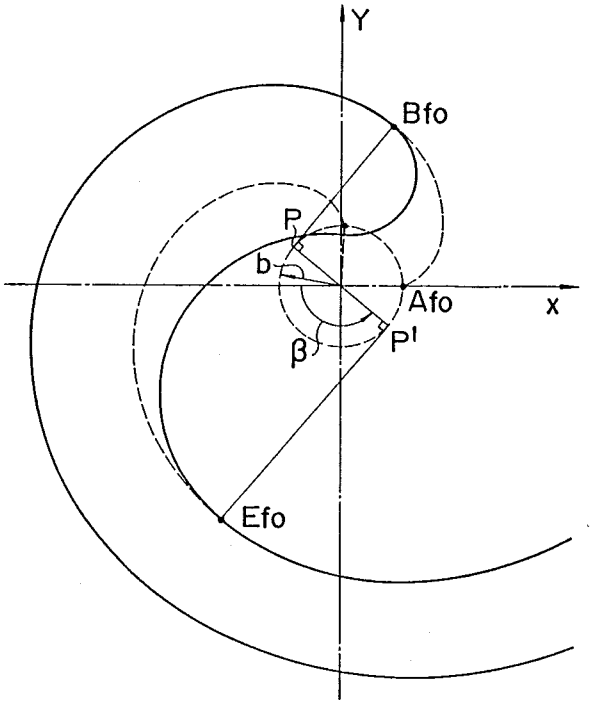
FIG. 4 is a front view showing the spiral element in the case of $\Delta T=0$ and $\beta_1=\beta_2=\beta$ in FIG. 1 or 2.

If ΔT is selected to zero (ΔT=O), and $\beta_1$, $\beta_2$ are equal to $\beta(\beta_1=\beta_2=\beta)$ the elements in this case having the same base circle radius and the revolution radius as the base circle radius b and the revolution radius $\rho$ shown in FIGS. 1 and 2 are shown in FIG. 4, which shows the configuration of the stationary spiral element and revolving spiral element.

Namely, $$n_1=n_2=n$$

$$Trf=Tro=\pi b-\rho$$

The configuration of the stationary spiral element is identical with that of the revolving spiral element, and the following three points exist in the same point.

Point Bf≡point Bo≡point Bfo

Point Af≡point Ao≡point Afo

Point Ef≡point Eo≡point Efo

More particularly, the present invention provides the stationary spiral element having the thickness reduced by ΔT with respect to the thickness Trf=Tro (Tro is the thickness of the involute portion of the revolving spiral element) of the involute portion of the stationary spiral element of FIG. 4 and the revolving spiral element having the thickness increased by ΔT with respect to the thickness of the involute portion of the revolving spiral element of FIG. 4.

At the same time, in the aforesaid preferred embodiment ($\Delta T+0$, $\beta_1=\beta_2=\beta$) the parameters $n_1$ and $n_2$ become equal as already explained before, and when expressed in terms of $n=n_1=n_2$, by changing the parameter n in several ways, it is possible to change the configuration of center of the spiral element.

Namely, in this case, a connection inner curve of the stationary spiral element and a connection inner curve of the revolving spiral element expressed by the aforesaid equations (1) and (17) respectively should become the same.

When they are expressed by $$\begin{vmatrix} x(t) \\ y(t) \end{vmatrix},$$

they will assume the following forms:

$$\begin{vmatrix} x(t) \\ y(t) \end{vmatrix} = \begin{vmatrix} xf_1(t) \\ yf_1(t) \end{vmatrix} = \begin{vmatrix} xm_1(t) \\ ym_1(t) \end{vmatrix} = \phi(t)\begin{vmatrix} r(t) \\ 0 \end{vmatrix} - \phi(\beta)\begin{vmatrix} b \\ d \end{vmatrix} \quad (23)$$

where $$t_c \leqq t \leqq \pi/2+\beta$$

Similarly, a connection outer curve of the stationary spiral element and construction outer curve of the revolving spiral element expressed by the aforesaid equation (2) and (18) respectively should become the same.

When they are expressed by $$\begin{bmatrix} x(t) \\ y(t) \end{bmatrix},$$

they will assume the following forms.

$$\begin{vmatrix} x(t) \\ y(t) \end{vmatrix} = \begin{vmatrix} xf_0(t) \\ yf_0(t) \end{vmatrix} = \begin{vmatrix} xm_0(t) \\ ym_0(t) \end{vmatrix}$$

$$= \phi\left(t - \tan^{-1}\left\{\frac{\frac{dr(t)}{dt}}{r(t)}\right\}\right)\begin{vmatrix} \rho \\ 0 \end{vmatrix} - \phi(t)\begin{vmatrix} r(t) \\ 0 \end{vmatrix} + \phi(\beta)\begin{vmatrix} b \\ d \end{vmatrix} \quad (24)$$

where $t_c \leqq t \leqq \pi/2+\beta$.

Figure 5A:
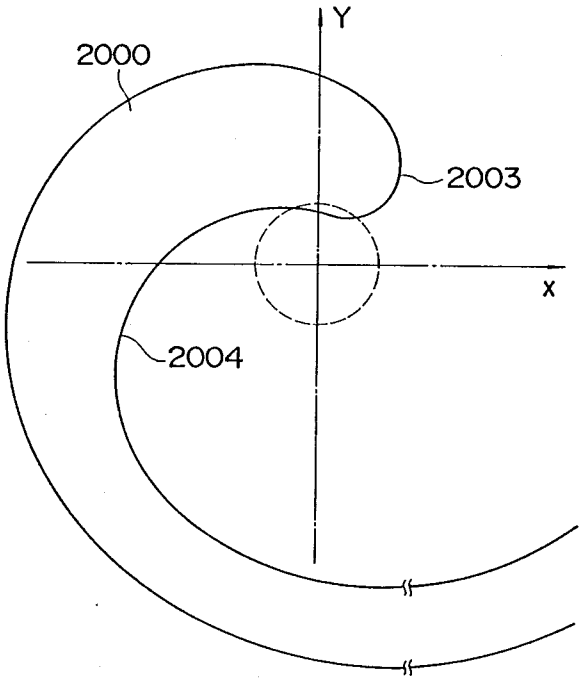
Figure 5C:
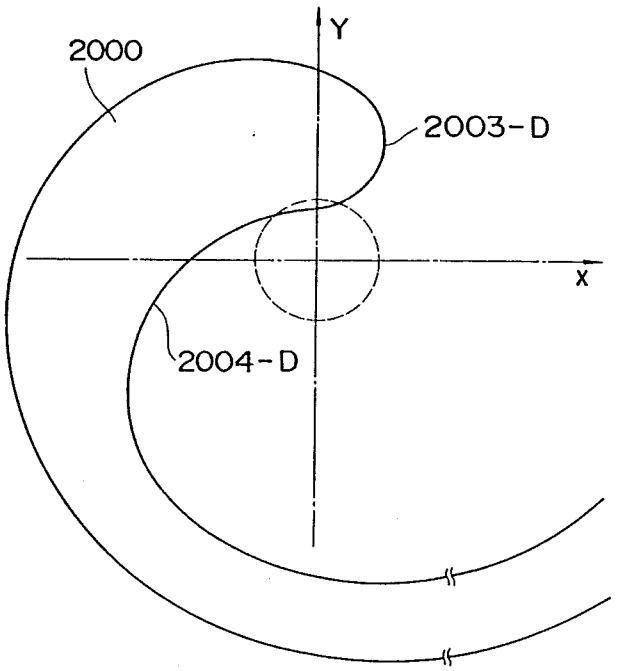
Figure 5B:
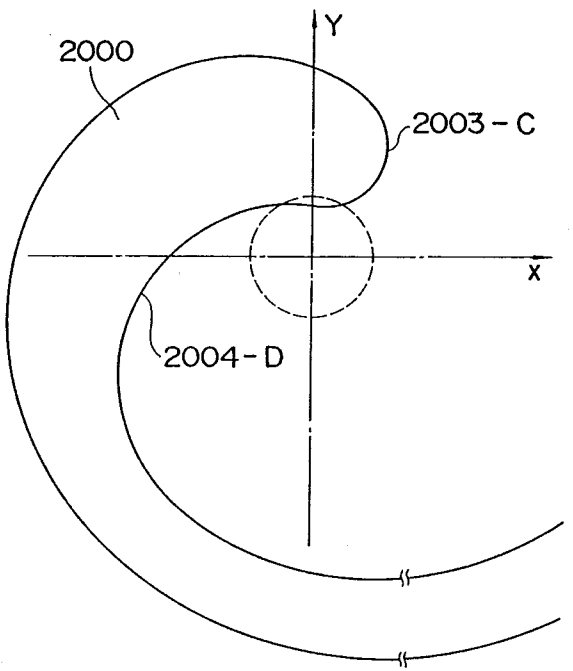
Figures 5, 5E:
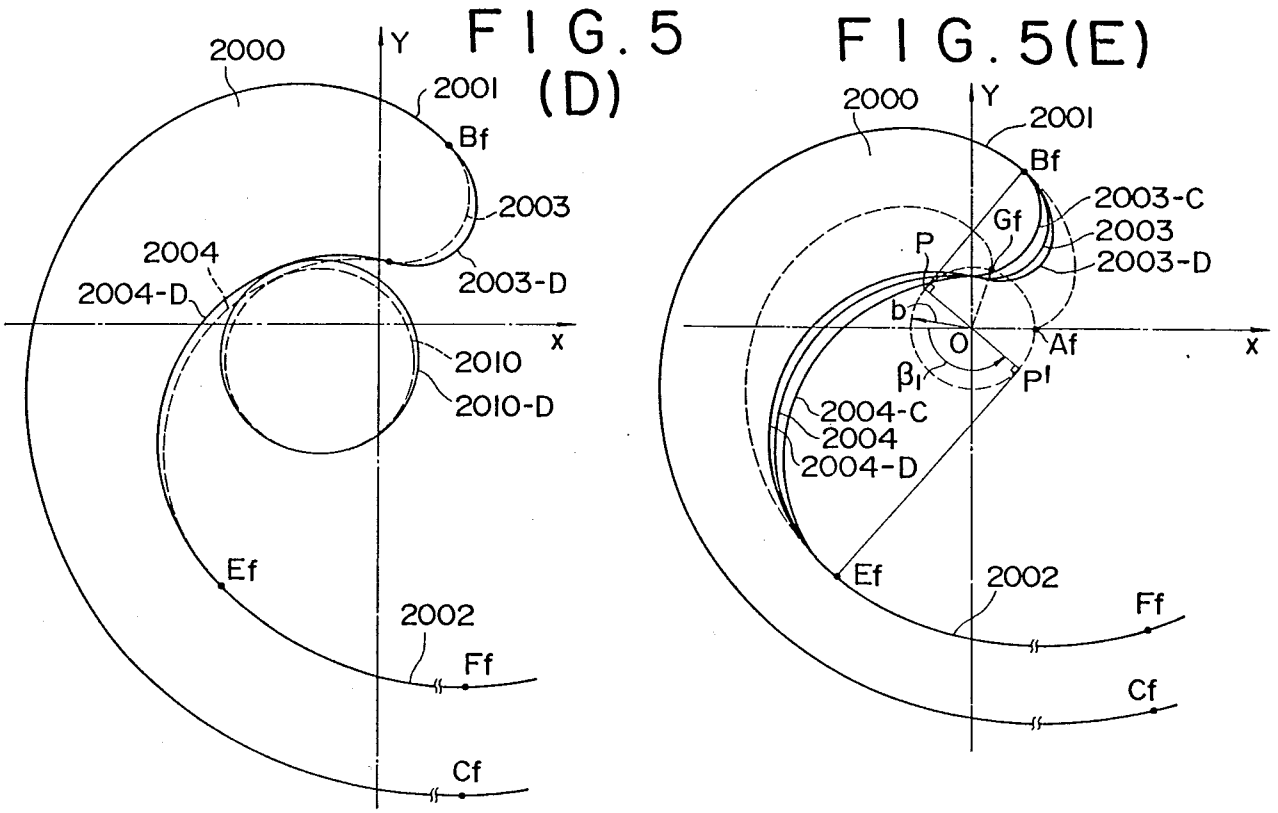

This case is shown in FIG. 5. FIG. 5(B) shows the connection outer curve having a relatively large radius of curvature as shown by the curve 2003C as compared with the curve 2003 of FIG. 5(A) by changing the parameter n (n>1) in order to increase the strength of the center thereof as compared with the stationary spiral element shown in FIG. 5(A) and FIG. 1. The connection inner curve corresponding to the connection outer curve is represented by 2004C.

On the contrary, if the strength is unnecessary, the parameter n can be changed (n<1) to make small the radius of curvature of the connection outer curve as shown by 2003D of FIG. 5(C). The connection inner curve corresponding to the connection outer curve is represented by 2004D.

In this case, the corresponding stationary spiral element has the same change in configuration and accordingly the area of the delivery port near the connection inner curve can be increased.

In this case, the connection outer curve changes from 2003 to 2003D. This case is shown in FIG. 5(D), in which reference numeral 2010 represents the delivery port for the connection curves 2003 and 2004, and reference numeral 2010 D represents the delivery port for the connection curve 2003 D and 2004 D.

As described above, in the present invention, the strength of the center of the spiral element can be enhanced or the delivery port having a large sectional area can be provided without varying the base circle radius b, the revolution radius $\rho$ and the parameter $\beta$ while the top clearance volume is maintained to zero.

FIG. 5(E) shows the spiral elements of FIGS. 5(A), (B) and (C) overlapped each other.

In FIG. 5(E), reference numerals 2004 and 2003 represent the connection inner curve and the connection outer curve, respectively, each having the parameter n=1, 2004 C and 2003 C represent the connection inner curve and the connection outer curve, respectively, each having the parameter n>1, and 2004 D and 2003 D represent the connection inner curve and the connection outer curve, respectively, each having the parameter n>1.

If n=1, the equations (1) and (17) expressing the connection inner curve and the equations (2) and (18) expressing the connection outer curve form arcs, respectively. In this case, the elements are identical with those of the conventional fluid machine disclosed in Japanese Patent Application No. 206,088/1982. The radii of the arcs are given by (i) For the curve of the stationary spiral element The radius Rf of the connection inner curve is:

$$Rf=R_1/2 \tag{25}$$

The radius rf of the connection outer curve is:

$$rf=R_2/2-\rho \tag{26}$$

(ii) For the curve of the revolving spiral element

The radius Ro of the connection inner curve is:

$$Ro=R_2/2 \tag{27}$$

The radius ro of the connection outer curve is:

$$Ro=R_1/2-\rho \tag{28}$$

Namely, in this case, the center of the spiral elements is formed by connection of the arcs and the shape thereof is simple.

In the above case, the following relations are formed:

$$r_1(t) = R_1\sin(t-\beta) \tag{29}$$

$$r_2(t) = R_2\sin(t-\beta) \tag{30}$$

$$t_c = \pi/2+\beta-\tan^{-1}(\lambda+\beta) \tag{31}$$

$$d_1/b = 1/(\lambda+\beta)+\lambda \tag{32}$$

$$R_1/b = [1+(\lambda+\beta)^2]/(\lambda+\beta)+2\lambda \tag{33}$$

$$d_2/b = 1/(\lambda+\beta)+\lambda \tag{34}$$

$$R_2/b = [1+(\lambda+\beta)^2]/(\lambda+\beta)+2\lambda \tag{35}$$

When all the aforesaid concrete examples are rearranged, they will assume what is shown in the following Table.

| | $n = n_1 = n_2$ $(\beta = \beta_1 = \beta_2)$ | | $n_1 \neq n_1$ $(\beta_1 \neq \beta_2)$ | | |
|---|---|---|---|---|---|
| | $n = 1, 0$ | $n \neq 1, 0$ | $n_1$ or $n_2 = 1, 0$ | $n_1$ and $n_2 \neq 1, 0$ | Remarks |
| $\Delta T = 0$ | Japanese Pat. Appln. No. 206088/1982 | Range expressed by eq.s (23) and (24) | | | Same thickness of involute portions both spiral elements |
| | Eq. (25)-Eq. (35) where n = 1 | | There occurs difference in configuration of portions except involute ones of both spiral elements | | |
| | Same configuration of both spiral elements | | | | |
| $\neq 0$ | None | | Range expressed by eq.s (1), (2), (17), and (18) | | Different thickner of involute portions of both spiral elements |

The present invention has various applications as described below without departing from intention thereof.

(1) In the above embodiment, the stationary spiral element is defined by the equations (1) and (2) while the revolving spiral element is defined by the equations (17) and (18), and vice versa.

Further, in the above embodiment, the thickness of the revolving spiral element is thicker that that of the stationary spiral element, and vice versa if necessary.

(2) Since the spiral element of the actual fluid machine has any working error, there is provided a small gap or clearance $\Delta$ in the connection curve portion in order to avoid abnormal contact between the connection curves due to the working error.

Figure 6:
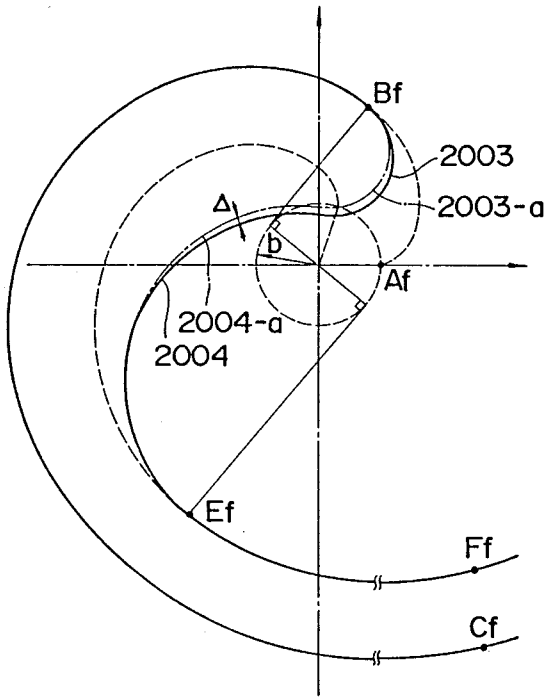
FIG. 6 is a front view of the stationary spiral element of FIG. 1 in the case where a small gap or clearance is given to the connection inner curve and outer curve of the stationary spiral element.
Figure 8A:
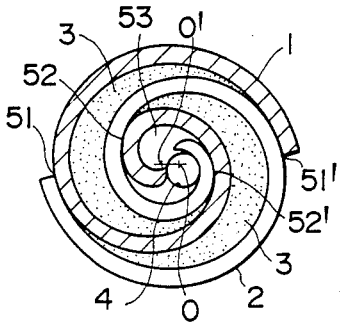
FIG. 8(A) (PRIOR ART)
FIGS. 8(A) to 8(D) schematically illustrate the principle of operation of a known scroll-type compression machine.
Figure 8B:
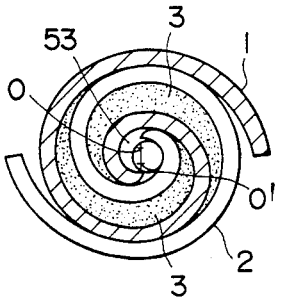
FIG. 8(B) (PRIOR ART)
Figure 8C:
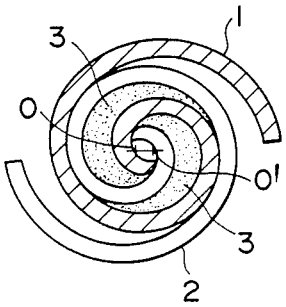
FIG. 8(C) (PRIOR ART)
Figure 8D:
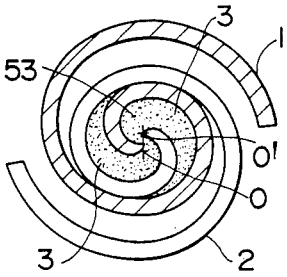
FIG. 8(D) (PRIOR ART)
Figure 9:
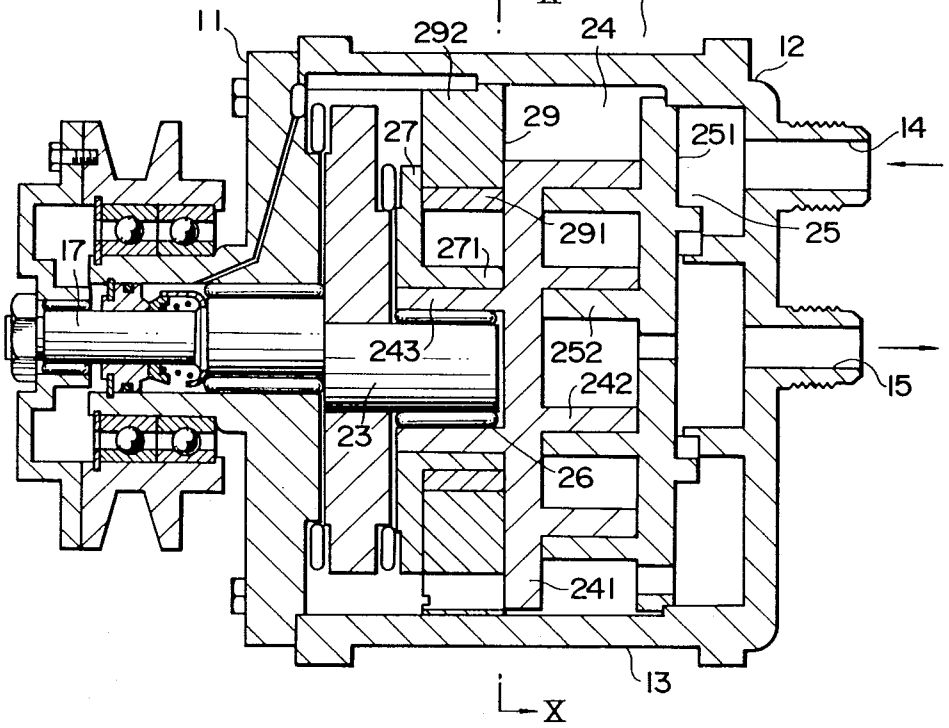
FIG. 9 (PRIOR ART)
FIG. 9 is a longitudinal cross-sectional view showing a known scroll-type compression machine.
Figure 10:
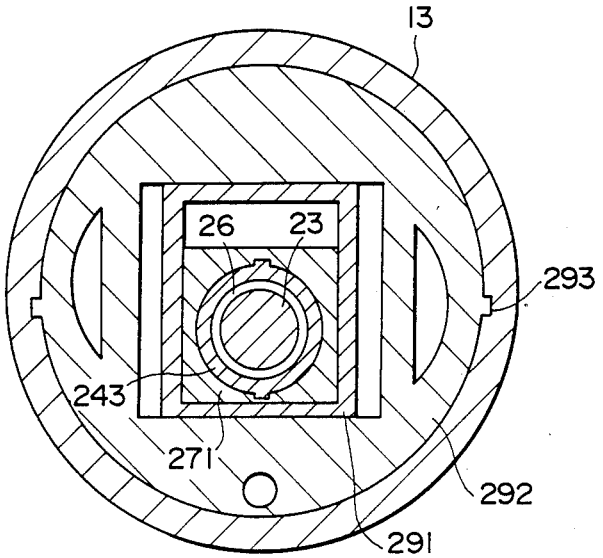
FIG. 10 (PRIOR ART)
FIG. 10 is a transversal cross-sectional view taken along the line X—X in FIG. 9.
Figure 12:
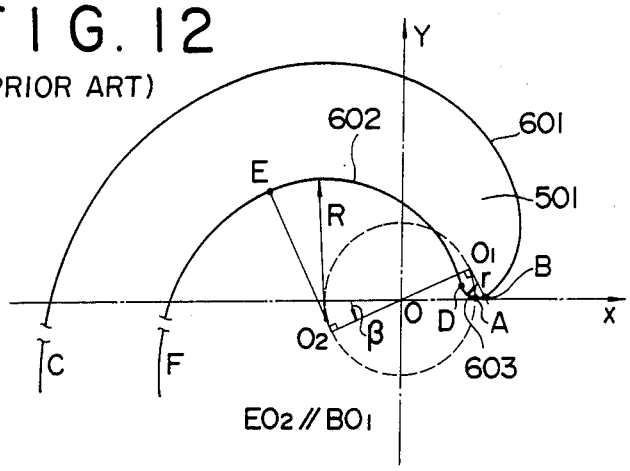
FIG. 12 (PRIOR ART)
FIG. 12 schematically illustrates the spiral element disclosed in the Japanese Patent Application No. 206,088/1982 filed by the present inventors.
Figure 13:
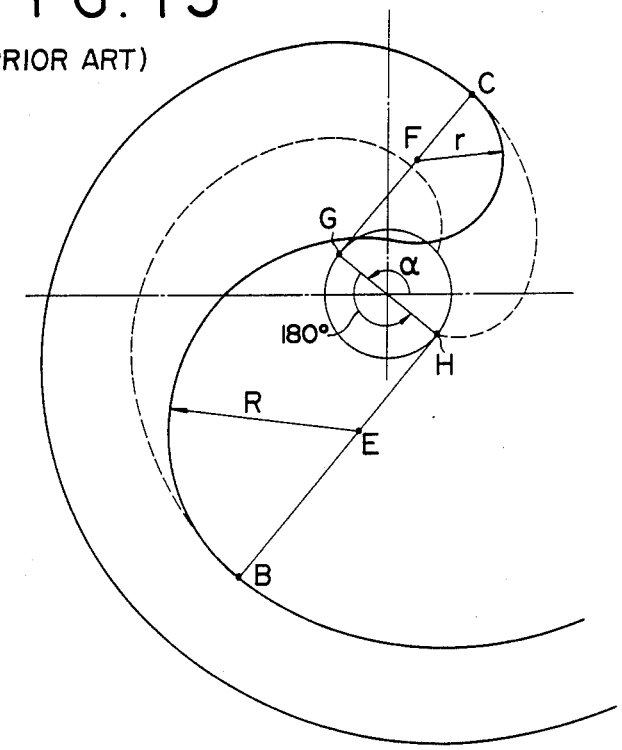
FIG. 13 (PRIOR ART)
FIG. 13 schematically illustrates the spiral element disclosed in the Japanese Patent Application No. 167,063/1982.

FIG. 6 shows the stationary spiral element having a small gap $\Delta$, in which there are shown a connection inner curve 2004-a and a connection outer curve 2003-a formed with the small clearance $\Delta$ with respect to the connection inner curve 2004 and the connection outer curve 2003 of the stationary spiral element of FIG. 1.

Further, it is a matter of course that the corresponding opposite stationary spiral element may be formed with a small gap $\Delta$ in the same manner or with a different gap or without any gap.

Figure 7:
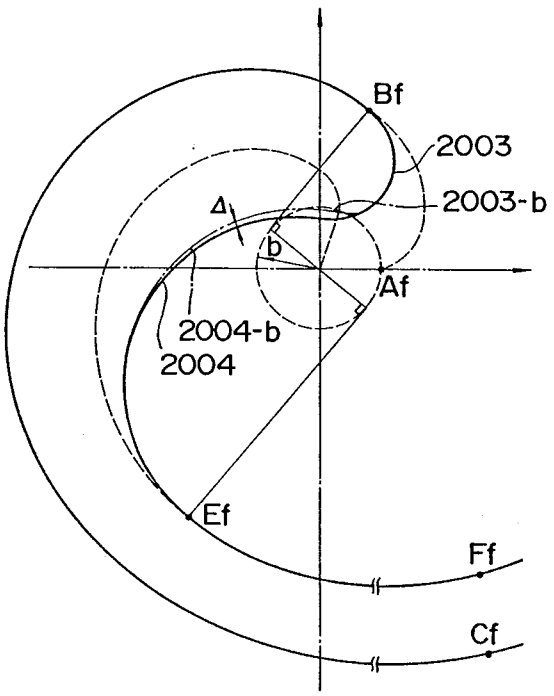
FIG. 7 is a front view of the stationary spiral element of FIG. 1 in the case where a small gap or clearance is given to the whole of the connection inner curve and a part of the connection outer curve of the stationary spiral element.

(3) FIG. 7 shows the stationary spiral element having a small gap $\Delta$ formed over the whole of a connection inner curve and in a part of a connection outer curve, in which there are shown a connection inner curve 2004-b and a connection outer curve 2003-b formed with the small clearance $\Delta$ over the whole of the connection inner curve 2004 and in a part of the connection outer curve 2003 of the stationary spiral element of FIG. 1.

In the same manner as described above, the opposite stationary spiral element may be formed with a gap or without any gap.

(4) While the foregoing description is directed to the compression machine, the present invention can be applied to any scroll-type fluid machine having a pair of spiral elements such as, for example, an expander, pump and the like.

We claim:

1. A scroll-type fluid machine including a stationary spiral element and a revolving spiral element having a substantially identical configuration and a central small chamber defined between abutting points of both the spiral elements a volume of which is adapted to be reduced to substantially zero with relative rotation of both the spiral elements, wherein each of said both spiral elements is defined in profile with an outer curve segment and an inner curve segment consisting of involute curves, and a portion between said outer curve segment and said inner curve segment is substantially formed of a connection inner curve expressed by the following equation (23) and a connection outer curve expressed by the following equation (24):

$$\begin{vmatrix} x(t) \\ y(t) \end{vmatrix} = \phi(t) \begin{vmatrix} r(t) \\ 0 \end{vmatrix} - \phi(\beta) \begin{vmatrix} b \\ d \end{vmatrix} \tag{23}$$

$$\begin{vmatrix} x(t) \\ y(t) \end{vmatrix} = \phi\left(t - \tan^{-1}\left\{\frac{\frac{dr(t)}{dt}}{r(t)}\right\}\right) \begin{vmatrix} \rho \\ 0 \end{vmatrix} - \phi(t) \begin{vmatrix} r(t) \\ 0 \end{vmatrix} + \phi(\beta) \begin{vmatrix} b \\ d \end{vmatrix} \tag{24}$$

where t is a variable with $t_c \leqq t \leqq \pi/2+\beta$ $\beta$ is the starting angle of the involute curve of the inside of the revolving and stationary spiral elements and the outside of the revolving spiral elements and the correction inner curve of the stationary spiral element b is the radius of the base $\rho$ is the radius of revolution $d=\{b^2-(\rho/2+b\beta)^2\}/2(\rho/2+b\beta)$.

2. A scroll-type fluid machine including a stationary spiral element and a revolving spiral element having a substantially identical configuration and a central small chamber defined between abutting points of both the spiral elements a volume of which is adapted to be reduced to substantially zero with relative rotation of both the spiral elements, wherein each of said both spiral elements is defined in profile with an outer curve segment and an inner curve segment consisting of involute curves, and one of the stationary spiral element and the revolving spiral element comprises a connection inner curve expressed by the following equation (1) and a connection outer curve expressed by the following equation (2) which are substantially formed between said outer curve segment and said inner curve segment while the other of the stationary spiral element and the revolving spiral element comprises a connection inner curve expressed by the following equation (17) and a connection outer curve expressed by the following equation (18) which are substantially formed between said outer curve segment and said inner curve segment:

a connection inner curve of one of the spiral elements:

$$\begin{bmatrix} xf_1(t) \\ yf_1(t) \end{bmatrix} = \phi(t) \begin{bmatrix} r_1(t) \\ o \end{bmatrix} - \phi(\beta_1) \begin{bmatrix} b \\ d_1 \end{bmatrix} \tag{1}$$

where t is a variable with $t_c \leqq t \leqq \pi/2+\beta_1$ $\beta_1$ is the starting angle of the involute curve of the inside of the stationary spiral element and the outside of the revolving spiral element.

b is the radius of the base $\rho$ is the radius of revolution and $d_1=\{b^2-(\rho/2+b\beta_1)^2\}/2(\rho/2+b\beta_1)$ a connection outer curve of one of the spiral elements:

$$\begin{bmatrix} xf_0(t) \\ yf_0(t) \end{bmatrix} = \phi[t - \tan^{-1}((dr_2(t)/dt)/r_2(t))] \begin{bmatrix} \rho \\ o \end{bmatrix} - \phi(t) \begin{bmatrix} r_2(t) \\ o \end{bmatrix} + \phi(\beta_2) \begin{bmatrix} b \\ d_2 \end{bmatrix} \tag{2}$$

where t is a variable with $t_c \leqq t \leqq \pi/2+\beta_2$ $\beta_2$ is a starting angle of the involute curve of the inside of the revolving spiral element and the connection inner curve of the stationary spiral element.

$d_2=\{b^2-(\rho/2+b\beta_2)^2\}/2(\rho/2+b\beta_2)$ b is the radius of the base $\tau$ is the radius of revolution a connection inner curve of the other of the spiral elements:

$$\begin{bmatrix} xm_1(t) \\ ym_1(t) \end{bmatrix} = \phi(t) \begin{bmatrix} r_2(t) \\ 0 \end{bmatrix} - \phi(\beta_2) \begin{bmatrix} b \\ d_2 \end{bmatrix} \tag{17}$$

where $t_c \leqq t \leqq \pi/2+\beta_2$ $\beta_2$ is a starting angle of the involute curve of the inside of the revolving spiral element and the connection inner curve of the stationary spiral element.

$d_2=\{b^2-(\rho/2+b\beta_2)^2\}/2(\rho/2+b\beta_2)$ b is the radius of the base $\rho$ is the radius of revolution a connection outer curve of the other of the spiral elements:

$$\begin{bmatrix} xm_0(t) \\ ym_0(t) \end{bmatrix} = \phi(t - \tan^{-1})((dr_1(t)/dt)/r_1(t))] \begin{bmatrix} \rho \\ 0 \end{bmatrix} - \phi(t) \begin{bmatrix} r_1(t) \\ 0 \end{bmatrix} + \phi(\beta_1) \begin{bmatrix} b \\ d_1 \end{bmatrix} \tag{18}$$

where: t is a variable with $t_c \leqq t \leqq \pi/2+\beta_1$ $\beta_1$ is the starting angle of the involute curve of the inside of the stationary spiral element and the outside of the revolving spiral element.

b is the radius of the base circle $\rho$ is the radius of revolution and $d_1=\{b^2-(\rho/2+b\beta_1)^2\}/2(\rho/2+b\beta_1)$.

* * * * *